US006144720A

United States Patent [19]

DeCou et al.

[11] Patent Number: 6,144,720

[45] Date of Patent: Nov. 7, 2000

[54] IRON OXIDE COATING FOR X-RAY TUBE ROTORS

[75] Inventors: Frank D. DeCou, Naperville; Paul M. Xu, Oswego; Robert J. Zielinski, Naperville, all of Ill.

[73] Assignee: Picker International, Inc., Highland Heights, Ohio

[21] Appl. No.: 09/143,121

[22] Filed: Aug. 28, 1998

[51] Int. Cl.[7] ..... H01J 35/10

[52] U.S. Cl. ..... 378/131; 378/129

[58] Field of Search ..... 378/129, 131

[56] References Cited

U.S. PATENT DOCUMENTS

| | | | |
|---|---|---|---|
| 2,111,412 | 3/1938 | Ungelenk | 250/35 |
| 4,788,705 | 11/1988 | Anderson | 378/121 |
| 4,878,235 | 10/1989 | Anderson | 378/136 |
| 5,046,186 | 9/1991 | Rohmfeld | 378/125 |
| 5,140,246 | 8/1992 | Rarick | 318/779 |
| 5,200,985 | 4/1993 | Miller | 378/135 |
| 5,241,577 | 8/1993 | Burke et al. | 378/135 |
| 5,274,690 | 12/1993 | Burke et al. | 378/135 |
| 5,299,149 | 3/1994 | Morita et al. | 364/576 |
| 5,384,820 | 1/1995 | Burke | 378/135 |
| 5,553,114 | 9/1996 | Siemers et al. | 378/129 |

*Primary Examiner*—Craig E. Church

*Attorney, Agent, or Firm*—Fay, Sharpe, Fagan, Minnich & McKee, LLP

[57] ABSTRACT

A high energy x-ray tube includes an evacuated chamber (12) containing a rotor (34) which rotates an anode (10) in the path of a stream of electrons (A) to generate an x-ray beam (B) and heat. The rotor includes an armature (36) which rotates around a stationary rotor support (40). An emissive coating is formed on the rotor by depositing an iron $Fe_3O_4$ oxide plasma onto the surface of the armature. Heat generated in the anode during the production of x-rays is conducted through the anode and the rotor to the emissive coating which irradiates the heat across vacuum, thereby increasing the lifetime of the tube. A stator (32) generates an oscillating magnetic field which induces opposing fields in the $Fe_3O_4$ coating to create the rotational forces to rotate the anode.

18 Claims, 1 Drawing Sheet

IRON OXIDE COATING FOR X-RAY TUBE ROTORS

BACKGROUND OF THE INVENTION

The present invention relates to the medical diagnostic arts, It finds particular application in connection with dissipation of heat from a rotating anode of an x-ray tube for use with CT scanners and will be described with particular reference thereto. It should be appreciated, however, that the invention is also applicable to dissipation of heat in other vacuum systems.

A high power x-ray tube typically includes a thermionic filament cathode and an anode which are encased in an evacuated envelope. A heating current, commonly of the order of 2–5 amps, is applied through the filament to create a surrounding electron cloud. A high potential, of the order of 100–200 kilovolts, is applied between the filament cathode and the anode to accelerate the electrons from the cloud towards an anode target area. The electron beam impinges on a small area of the anode, or target area, with sufficient energy to generate x-rays. The acceleration of electrons causes a tube or anode current of the order of 5–200 milliamps. Only a small fraction of the energy of the electron beam is converted into x-rays, the majority of the energy being converted to heat which heats the anode white hot.

In high energy tubes, the anode rotates at high speeds during x-ray generation to spread the heat energy over a large area and inhibit the target area from overheating. The cathode and the envelope remain stationary. Due to the rotation of the anode, the electron beam does not dwell on the small impingement spot of the anode long enough to cause thermal deformation. The diameter of the anode is sufficiently large that in one rotation of the anode, each spot on the anode that was heated by the electron beam has substantially cooled before returning to be reheated by the electron beam.

The anode is typically rotated by an induction motor. The induction motor includes driving coils, which are placed outside the glass envelope, and an armature, within the envelope, which is connected to the anode. When the motor is energized, the driving coils induce electric currents and magnetic fields in the armature which cause the armature to rotate.

The temperature of the anode can be as high as 1,400° C. Part of the heat is transferred to the armature and associated bearings. Most of the heat from the anode and armature is dissipated by thermal irradiation through the vacuum to the exterior of the envelope. Limited amounts of heat pass by conduction through the bearings and the bearing races. It is to be appreciated that heat transfer from the anode through the vacuum is limited. Overheating can cause damage to the anode, armature, and bearings, resulting in wobble and a lack of focus of the x-ray beam.

Several methods have been used to increase the rate of dissipation of heat from the rotor. In one method, a coating of chromium oxide or a mixed alumina-titanium oxide is applied to the armature. For high-end CT tubes, however, the coating is not fully effective at dissipating heat. The emissivities of chromium oxide and aluminum-titanium oxide are relatively low and the coating has adhesion problems, i.e. it tends to peel from the rotor with extended use.

In a second method, both the anode and vacuum envelope are rotated, while the cathode remains stationary. This configuration permits a coolant fluid to be circulated through the anode to provide a direct thermal connection between the anode and the exterior of the envelope. See, for example, U.S. Pat. Nos. 5,046,186; 4,788,705; 4,878,235; and 2,111,412.

One of the difficulties with this configuration is holding the cathode stationary within the rotating envelope. When the cathode assembly is supported by structures which are rotating with the envelope at a high speed, it tends to rotate with the anode and the envelope. Also, larger, more powerful motors are needed to rotate the larger anode and vacuum envelope assembly.

The present invention provides a new and improved x-ray tube and high emissivity coating which overcomes the above referenced problems and others.

SUMMARY OF THE INVENTION

In accordance with one aspect of the present invention, a high energy x-ray tube for providing a beam of x-rays is provided. The tube includes a glass envelope which defines an evacuated chamber and a cathode disposed within the chamber for providing a source of electrons. An anode is disposed within the chamber for receiving the electrons and generating the beam of x-rays. A rotor rotates the anode relative to the cathode. An emissive coating on a surface of the rotor within the evacuated chamber comprises a metallic oxide of iron.

In accordance with another aspect of the present invention, a method of increasing the emissivity of a rotor of a high energy x-ray tube is provided. The method includes coating a surface of the rotor with an emissive coating which includes a magnetic iron oxide.

In accordance with a still further aspect of the present invention, a method of generating x-rays is provided. The method includes generating a cloud of electrons within an evacuated region and propelling the electrons against a surface of an anode to generate x-rays and heat. The method further includes applying an oscillating magnetic field to an $Fe_3O_4$ coating on a rotor which is rotatably mounted within the evacuated region and which is connected with the anode to rotate the anode surface. The oscillating field induces eddy currents and opposing magnetic fields in the $Fe_3O_4$ coating to create a driving force to rotate the anode.

One advantage of the present invention is that it increases dissipation of heat from a rotating anode.

Another advantage of the present invention resides in increased life of the tube.

Yet another advantage of the present invention resides in improved magnetic properties of the rotor.

Yet a still further advantage of the present invention is that the occurrence of arcing within the tube is reduced due to the reduction of particles generated by the coating and its increased electrical conductivity as compared with present coatings.

Still, further advantage of the present invention will become apparent to those of ordinary skill in the art upon reading and understanding the following detailed description of the preferred embodiment.

BRIEF DESCRIPTION OF THE DRAWINGS

The invention may take form in various components and arrangements of components and in various steps and arrangements of steps. The drawing is only for purposes of illustrating a preferred embodiment, and is not to be construed as limiting the invention.

The FIGURE is a schematic view of a rotating anode tube according to the present invention.

DETAILED DESCRIPTION OF THE PREFERRED EMBODIMENT

Figure 1:
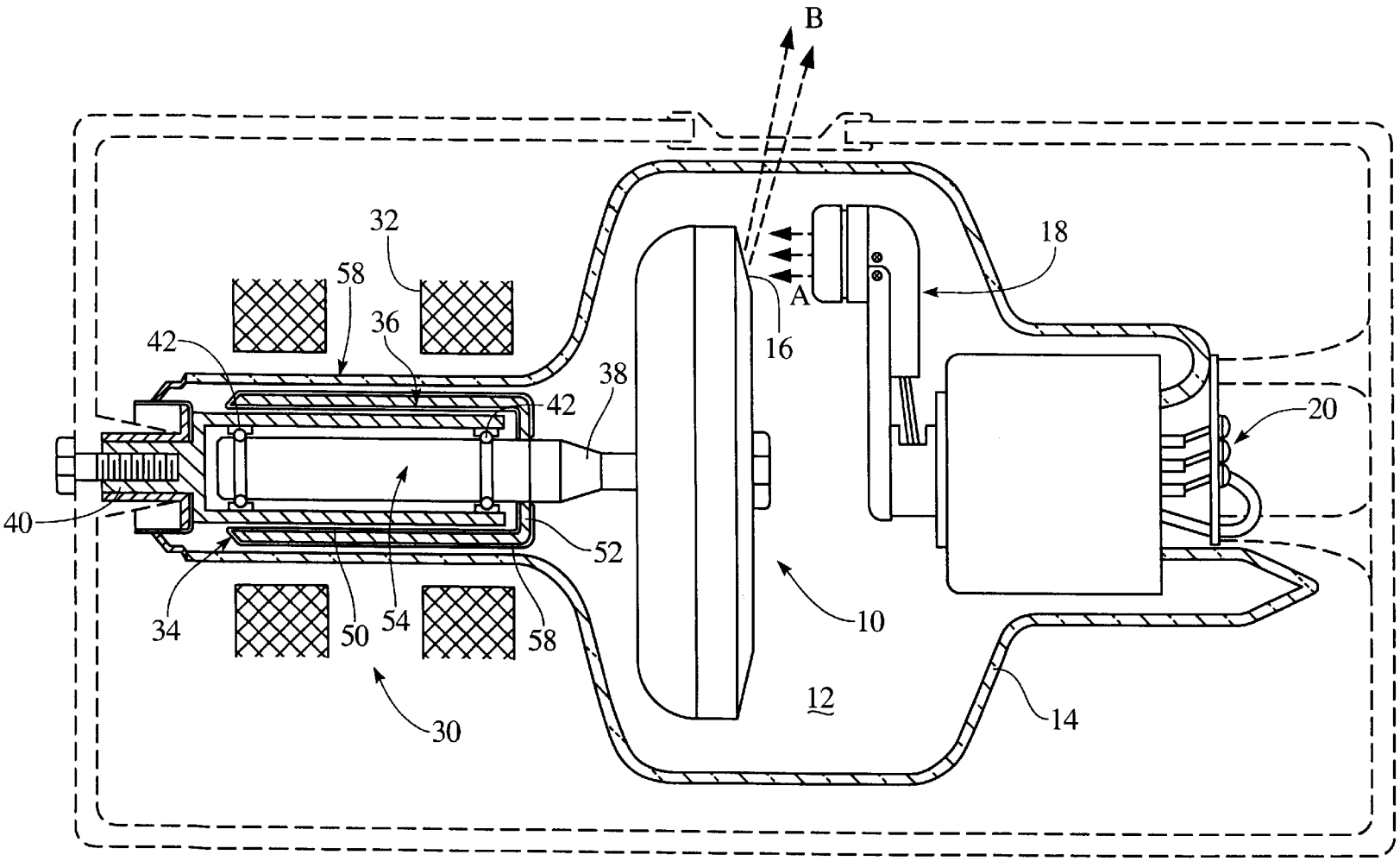

With reference to the FIGURE, a rotating anode tube of the type used in medical diagnostic systems for providing a focused beam of x-ray radiation is shown. A rotating anode 10 is operated in an evacuated chamber 12 defined by a glass envelope 14. The anode it disc-shaped and beveled adjacent its annular peripheral edge to define an anode surface or target area 16. A cathode assembly 18 supplies an electron beam A which bombards the anode surface 16. Filament leads 20 lead in through the glass envelope to the cathode assembly to supply an electrical current to the assembly. When the electron beam strikes the rotating anode, a portion of the beam is converted to a beam or x-rays B which is emitted from the anode surface and passes out of the tube through the envelope 14.

The entire anode 10 is typically sintered tungsten, or a composite material, which has been hardened by compressing the anode at high pressures. Alternatively, the anode surface 16 may be defined by an annular strip of tungsten which is connected to a thermally conductive disk or substrate.

An induction motor 30 rotates the anode 10. The induction motor includes a stator having driving coils 32 which are positioned outside the envelope and a rotor 34, within the envelope, which is connected to the anode 10. The rotor includes an armature or sleeve 36 which is connected to the anode by a neck or shaft 38 of molybdenum or other suitable material. The armature 36 is formed from a thermally and electrically conductive material, such as copper.

When the motor is energized, the driving coils induce opposing magnetic fields in the armature which cause the armature to rotate relative to the stator and a rotor support 40. Bearings 42, such as ball or roller bearings, are positioned between the armature and the rotor support to allow the armature to rotate smoothly about the rotor support 40.

The armature 36 preferably defines an outer cylindrical armature portion 50 with a base or shoulder portion 52 and a central shaft 54 which extends from an inner surface of the base 52 of the cylindrical outer armature portion 50. In the illustrated embodiment, the bearings 42 are located between the central shaft and a cylindrical portion 56 of the rotor support 40 which extends into the outer armature portion 50. However, other configurations for the rotor are also contemplated. For example, the rotor support 40 may define a central shaft. The bearings, in such an embodiment, are positioned between the central rotor support shaft and the cylindrical outer armature portion.

The surfaces of the armature 36 have a high-emissivity coating 58 which is primarily $Fe_3O_4$. The coating is preferably applied by deposition from a plasma onto the entire surface of the armature, although other coating methods are also contemplated, such as electro-deposition of iron followed by an oxidizing procedure.

The $Fe_3O_4$ coating 58 provides a number of benefits to the operation of the x-ray tube. First, the coating is ferromagnetic, which leads it to function more effectively as part of the motor. Stronger opposing magnetic fields are induced in the coating than in the copper armature substrate. The driving coils 32 generate an alternative magnetic field to drive the rotation of the rotor 34. The $Fe_3O_4$ coating increases eddy currents in the rotor surface and the strength of the opposing magnetic fields on the rotor.

Second,the emissivity of the $Fe_3O_4$ coating is higher than that of conventional armature coatings, such as chromium oxide, thereby increasing the rate of heat dissipation from the anode. Emissivity values of the $Fe_3O_4$ coating at elevated temperatures are of the order of 0.9 compared with about 0.75 for chromium oxide.

Third, there is much less tendency for the coating to peel than for conventional coatings. The thermal expansion coefficient of $Fe_3O_4$ is much closer to that of copper than is the coefficient of aluminum oxide ($Al_2O_3$). The thermal expansion coefficients of copper, $Fe_3O_4$ , and $Al_2O_3$ at 550° C. (a typical operating temperature for the armature) are $20.1\times10^{-6}$, $14.5\times10^{-6}$, and $7.23\times10^{-6}$, respectively. The coating also adheres well to the copper armature. A minimum bond strength of $Fe_3O_4$ on copper is 5,000 psi, which is approximately 25 percent higher than for an $Al_2O_3$ coating. Therefore, at elevated temperatures, the adhesion of the $Fe_3O_4$ coating on the copper armature is better than for an $Al_2O_3$ coating.

Fourth, the $Fe_3O_4$ coating is conductive. During use of the x-ray tube, part of the eddy current forms in the $Fe_3O_4$ coating, reducing the bearing temperature.

It should be appreciated that in the FIGURE, the coating 58 is tot shown to scale. For ease of reference, the thickness of the coating is enlarged in the FIGURE. The thickness of the coating 58 is preferably up to about 0.10 mm. Above about 0.05 mm, the thermal conductivity of the coating decreases and rotor heat is not so readily passed through it. More preferably, the thickness of the coating is in the range of 0.04–0.05 mm.

The $Fe_3O_4$ plasma for depositing the coating is preferably formed from a high purity iron oxide powder. Although small amounts of impurities are permissible, the coating is preferably as pure as possible, that is, about 99 percent pure or above. Optionally, the coating covers the entire outer surfaces of the copper armature. Alternatively, only the outer surfaces of the armature that are adjacent the envelope are coated. Additionally, other surfaces of the rotor may be coated with the emissive coating, including the rotor support and neck, and the under side of the anode.

Tubes formed with the $Fe_3O_4$ iron oxide coating show extended tube life. In field use, lifetimes of 150,000 exposures and above have been obtained, higher than for conventional coatings.

The invention has been described with reference to the preferred embodiments. Obviously, modifications and alterations will occur to others upon reading and understanding the preceding detailed description. It is intended that the invention be construed as including all such modifications and alternations in so far as they come within the scope of the appended claims or the equivalents thereof.

What is claimed is:

1. A method of increasing the emissivity of a rotor of an x-ray tube, the method comprising:

coating the rotor with a coating which includes $Fe_3O_4$.

2. The method of claim 1, wherein the coating is deposited on an armature of the rotor by plasma deposition.

3. An x-ray tube including:

an evacuated envelope;

a cathode disposed within the envelope for providing a source of electrons;

an anode disposed within the envelope for receiving the electrons and generating x-rays;

a rotor for rotating the anode relative to the cathode; and a coating on the rotor within the evacuated envelope, the coating comprising $Fe_3O_4$ .

4. The x-ray tube of claim 3, wherein the coating has a thickness of less than 0.10mm.

5. The x-ray tube of claim 4, wherein the coating is at least 99% $Fe_3O_4$.

6. The anode tube of claim 5, wherein the thickness of the coating is 0.04 to 0.05 mm.

7. The x-ray tube of claim 3, wherein the rotor includes:

an armature which rotates relative to a rotor support when an induction current is applied to the rotor, and the coating covers the armature.

8. The x-ray tube of claim 7, wherein the armature is formed from copper.

9. An x-ray tube comprising:

a cathode;

an anode; and, a shaft connected to the anode, the shaft having a ferromagnetic coating comprising a metallic oxide of iron which includes $Fe_3O_4$ .

10. The x-ray tube of claim 9, wherein the shaft is a rotor adapted to rotate the anode.

11. A method of generating x-rays comprising:

generating a cloud of electrons within an evacuated region;

propelling the electrons against a surface of an anode to generate x-rays and heat;

applying an oscillating magnetic field to an $Fe_3O_4$coating on a rotor which is rotatably mounted within the evacuated region and which is connected with the anode to rotate the anode surface, which oscillating field induces eddy currents and opposing magnetic fields in the $Fe_3O_4$ coating to create a driving force to aid rotation of the anode.

12. The method of claim 11, wherein the $Fe_3O_4$ coating is carried on a thermally conductive substrate, which thermally conductive substrate is connected to the anode with thermally conductive materials, the method further including:

conducting the heat generated on the anode through the thermally conductive materials and substrate to the $Fe_3O_4$ coating; and, irradiating the heat from the $Fe_3O_4$ coating through the evacuated region.

13. An x-ray tube comprising:

a cathode;

an anode;

a rotor connected to the anode and adapted to rotate the anode within the x-ray tube, the rotor having a coating formed from $Fe_3O_4$.

14. The x-ray tube of claim 13, wherein the coating is on the surface of the rotor.

15. The x-ray tube of claim 13, wherein the rotor includes:

an armature which rotates when an induction current is applied to the rotor wherein the coating is on the armature.

16. In an x-ray tube having a cathode, an anode and a rotor connected to the anode for rotating the anode with the x-ray tube, further including a coating on the rotor composing a metallic oxide of iron which includes $Fe_3O_4$.

17. The x-ray tube of claim 16, wherein the rotor includes:

an armature which rotates when an induction current is applied to the rotor wherein the coating is on the armature.

18. The x-ray tube of claim 17, wherein the coating is on the surface of the rotor.

* * * * *